United States Patent [19]

White

[11] 4,423,814

[45] Jan. 3, 1984

[54] SEPARATION OR CONCENTRATION OF MAGNESIUM-BEARING MINERALS BY INDUCED FLUORESCENCE

[75] Inventor: William R. White, Capistrano Beach, Calif.

[73] Assignee: Occidental Research Corporation, Irvine, Calif.

[21] Appl. No.: 270,730

[22] Filed: Jun. 5, 1981

[51] Int. Cl.[3] ..... B07C 5/02; B07C 5/34

[52] U.S. Cl. ..... 209/3.3; 209/576

[58] Field of Search ..... 209/1, 2, 3, 3.1, 3.2, 209/3.3, 552, 576, 577, 578, 4, 9; 250/340, 341, 362

[56] References Cited

U.S. PATENT DOCUMENTS

| | | | |
|---|---|---|---|
| 2,966,988 | 1/1961 | Nury et al. | 209/3.3 |
| 3,346,111 | 10/1967 | Thompson et al. | 209/3.3 |
| 3,356,211 | 12/1967 | Mathews | 209/3.1 |
| 3,795,310 | 3/1974 | Buchot et al. | 209/3.3 X |
| 4,169,045 | 9/1979 | Moudgil et al. | 209/3.3 |
| 4,207,175 | 6/1980 | Moudgil | 209/3.3 |

FOREIGN PATENT DOCUMENTS

| | | | |
|---|---|---|---|
| 638375 | 12/1978 | U.S.S.R. | 209/3.3 |

*Primary Examiner*—Robert B. Reeves
*Assistant Examiner*—Edward M. Wacyra
*Attorney, Agent, or Firm*—Barry A. Bisson; Forrest E. Logan

[57] ABSTRACT

A method for the separation of magnesium-bearing ore particles containing an exposed magnesian-rich mineral on the surface from the lean ore particles containing a lesser surface area of the exposed magnesian mineral which comprises conditioning the ore with a coupling agent of hydroxyquinoline; irradiating the conditioned ore to excite and induce fluorescence; and separating the magnesian-rich mineral from the lean ore particles by detecting the difference of the fluorescence intensity.

7 Claims, No Drawings

SEPARATION OR CONCENTRATION OF MAGNESIUM-BEARING MINERALS BY INDUCED FLUORESCENCE

CROSS REFERENCE TO RELATED APPLICATIONS

The application is related to U.S. Pat. Nos. 3,356,211; 3,472,375; 3,722,676; 4,169,045; 4,207,175; 4,208,272; 4,208,273; 4,235,708; and 4,241,102; and to the following commonly owned, copending U.S. applications: Ser. No. 897,946 filed Apr. 19, 1978 (now abandoned); Ser. No. 36,637 filed May 7, 1979, now U.S. Pat. No. 4,326,950; Ser. No. 45,185 filed June 4, 1979; Ser. No. 203,738 filed Nov. 3, 1980, now abandoned; Ser No. 220,656 filed Dec. 29, 1980, now U.S. Pat. No. 4,352,731; PCT application No. 80/01618 filed Dec. 5, 1980; and to the following three applications, which were filed on the same day as this application, Ser. No. 270,729 of DiGiacomo and White, Park and McKinley, titled "Process for Sorting Limonitic from Non-Limonitic Ores"; Ser. No. 270,732 of DiGiacomo, titled "Process Using Detectable Marking Compounds to Sort Particles" and Ser. No. 270,728 of DiGiacomo and White, titled "Process for Beneficiation of Particulate Ores Containing A Silver-Bearing Mineral" and PCT Application No. 80/01618 filed Dec. 5, 1980.

The above referenced patents and applications disclose apparatus, materials and techniques which are useful in the concentration of various minerals and which can be used in practice of the present invention.

BACKGROUND OF THE INVENTION

The present invention relates to a method for the separation of magnesium-bearing minerals from ores. More particularly, it relates to a method for separating such magnesium-bearing minerals such as magnesite, brucite, talc and the like from gangue minerals such as quartz, feldspar, calcite, gypsum and others.

As used herein the term "gangue" is relative; that is, in some cases the desired product may be the gangue and the magnesium-bearing compound can be the waste or "discard" fraction. In other cases, the gangue may be further processed (as by the processes in the previously referenced patents and applications) to separate or concentrate a desired component of the gangue.

It is also to be understood that the term "separation" includes concentration, as by separating lower magnesium-content mineral particles as "gangue" from desired higher magnesium-concentration mineral particles. It is also to be understood that the process of the present invention involves differences between surface properties of ore particles, that is, if a given ore particle has a given total surface area of which half is a magnesium-bearing mineral, it will be coated to the same extent as a particle of twice that total area of which only a quarter of its surface area is a magnesium-bearing mineral. Of course, the total mass of each such particle will be greatly different and this factor plus the difference in total surface can be used to effectively separate the two particles, if desired, as will be discussed hereinafter in connection with the apparatus of U.S. Pat. Nos. 3,472,375 and 3,722,676. Other apparatus which can be used for such separations is shown in U.S. Pat. No. 3,975,310 to Buchot.

Magnesium minerals are mined for use in making such products as magnesium metal, refractories, porcelains, and medicinals. Among the principal ores are magnesite ($MgCO_3$) and brucite [$Mg(OH)_2$] which are mined and processed by flotation and other physical separation techniques. Other ores, such as talc and chrysotile, are mined and hand-graded to get sufficient purity for commercial use.

SUMMARY OF THE INVENTION

In one aspect, the invention involves a process for separation of magnesium-rich ore particles containing an exposed magnesian mineral on the surface from lean ore particles containing a lesser surface area of the exposed magnesian mineral. One embodiment of this process comprises the steps of:

a. conditioning a particulate ore comprising magnesium-rich ore particles and magnesium-lean ore particles with a conditioning agent comprising at least one hydroxyquinoline which by irradiation with electromagnetic radiation can be induced to fluoresce at at least one particular wavelength when combined with the magnesian mineral on the surface of the ore particle and which causes the magnesium-lean ore particles after said conditioning and upon irradiation to fluoresce at a substantially lower intensity or not at all at the particular wavelength than the intensity of fluorescence of the irradiated, conditioned, magnesium-rich ore particles;

b. after said conditioning, irradiating the conditioned ore with electromagnetic radiation to produce sufficient fluorescence of the conditioned magnesium-rich ore particles to enable the difference in fluorescent intensity between the irradiated, conditioned magnesium-rich ore particles and the irradiated conditioned lean ore particles to be detected;

c. detecting the fluorescent intensity of the irradiated, conditioned ore particles; and, d. separating said magnesium-rich ore particles from the lean ore particles based on the detected differences in fluorescent intensity of said conditioned, irradiated ore particles.

The invention can involve a method of separating a magnesian mineral from its gangue by conditioning, i.e. contacting, it in particulate form with a reagent which renders the surface of the magnesium-containing portion of the mineral fluorescent while leaving the remaining portion of the surface non-fluorescent or, if it is naturally fluorescent, at least non-fluorescent in the wavelength where the treated magnesium compound fluoresces. The reagent selected is one of the family of compounds called the hydroxy quinolines. The compound of common commercial availability in this group is 8-hydroxyquinoline, which can be used in an aqueous solution and, more preferably, in an alkaline aqueous solution. The magnesium salt of 8-hydroxyquinoline, which is insoluble in water, is fluorescent upon excitation with ultraviolet radiation. It apparently forms a coating on the surface of the magnesian compounds in the mineral. The magnesian mineral can be separated from its uncoated (or lesser coated) gangue due to this induced fluorescence. Prior to treatment (i.e. conditioning) with the hydroxyquinoline, the ore is crushed to a size to give sufficient liberation of the magnesian mineral after treatment with the reagent solution, the ore is exposed to radiation to induce fluorescence and separated, preferably in a sorting apparatus, such as those of U.S. Pat. Nos. 3,472,375 and 3,772,676, which can detect the fluorescent particles and physically remove them from the gangue. The sorting apparatus can be set to separate particles which possess a higher or lower intensity corresponding to the magnesium content of the rock. In this way, recovery and purity can be controlled.

DETAILED DESCRIPTION OF THE INVENTION

The practice of the process of this invention involves the separation of a magnesian mineral from an ore containing the desired mineral and other, usually unwanted, minerals, called gangue. Examples of such, but by no means all, magnesian minerals include magnesite ($MgCO_3$), brucite [$Mg(OH)_2$]), periclase ($MgO$), dolomite [$CaMg(CO_3)_2$] and talc [$Mg_3Si_4O_{10}(OH)_2$]. The ore to be separated is conditioned with a coupling agent which will adhere to the magnesian mineral but will not coat the gangue. Such a coupling agent can be found in the hydroxyquinoline family of compounds, some of which are available commercially. For example, 8-hydroxyquinoline is used as a precipitant for various di- and trivalent cations. The magnesium salt of this compound has been found to be highly fluorescent when excited with ultra-violet light. When a magnesian mineral is conditioned with this reagent, a magnesium 8-hydroxyquinolinate probably forms on the surface of the mineral and is rendered fluorescent by exposure to electromagnetic radiation, such as ultraviolet light. The magnesian mineral particles can then be separated from the substantially non-coated gangue particles by eye or an optical detection apparatus.

The process of the present invention is based upon the differences in surface chemical properties of the material present in the ore. Due to these differences, there can be utilized a coupling agent that will substantially-selectively coat only the magnesian mineral present.

The term "substantially-selectively coat" is used herein to mean that the magnesian mineral, which is to be separated, is coated to a sufficiently greater extent than the remainder of the components of the ore, such that separation can be made based on the difference in the degree of coating.

By proper selection of the coupling agent, the desirable magnesian mineral can be separated from the undesirable refuse. Surface chemical properties are relatively more consistent than other properties such as color, reflectance, or conductivity. By the same token, separation of materials based upon the surface chemical properties is usually more consistent than techniques based upon the above other properties.

Following coating of an ore particle mixture with the coupling agent, the ore particle can be radiated with electromagnetic radiation to cause the coating to fluoresce on the magnesian mineral while the noncoated material does not substantially fluoresce, thereby enabling the particles to be separated by differences in fluorescence.

Generally, fluorescence refers to the property of absorbing radiation at one particular wavelength and simultaneously reemitting light of a different wavelength, so long as the stimulus is active. It is intended in the present method to use the term "fluorescence" to indicate that property of absorbing radiation at one particular wavelength and re-emitting it at a different wavelength, whether or not visible, during exposure to an active stimulus, or after exposure, or during both these time periods. Thus, fluorescence is used generically herein to include fluorescence and phosphorescence, and envisions the emission of electromagnetic waves whether or not within the visible spectrum.

Electromagnetic radiation generally refers to the emission of energy waves of all the various wavelengths encompassed by the entire electromagnetic spectrum. It is intended in the present method to use the term "electromagnetic radiation" to indicate any and all stimuli that will excite and induce fluorescence of the fluorescent agent. Thus, electromagnetic radiation is used generically herein to include electromagnetic radiation and envisions other stimuli that will excite and induce fluorescence of a fluorescent agent.

The method of this invention is practiced in regard to an ore particle mixture containing a desired magnesian mineral by conditioning the ore particles, usually following a sizing step, with a coupling agent that selectively adheres to a magnesian compound in the mineral. The coupling agents that are selective for the magnesian mineral are members of a family of compounds called the hydroxyquinolines such as 8-hydroxyquinoline.

Generally, in practicing the present method, the ore containing the magnesium-bearing mineral is first subjected to a crushing step. The ore is crushed to substantially physical separate the magnesium mineral from the refuse present. Crushing increases the surface area of the particles and further provides a greater surface and reactive sites for the coating of the particles by the coupling agent. In this crushing step, the ore, as mined, is typically crushed to a particle size from about $\frac{1}{4}$ to about 8 inches (that is, by the usual measurement techniques using standard screens). It is preferred to crush the ore in particle sizes of from about $\frac{1}{2}$ to 3 inches. Particles of less than $\frac{1}{4}$ inch and greater than 8 inches can be used in the the practice of the method of this invention. However, the coating and separation of ore particles less than $\frac{1}{4}$ inch is less economically attractive and ore particles of greater than 8 inches entrain sufficiently greater amounts of impurities, so as to make the separation process less efficient. Usually the crushing will be followed by a sizing step. Following the crushing and sizing processes, the ore can be washed and deslimed to remove soluble impurities and surface fines on the particles.

After the crushing, sizing and desliming (or washing) steps, the ore is conditioned with a coupling agent of the hydroxyquinoline family, preferably 8-hydroxyquinoline and derivatives thereof, most preferred, 8-hydroxyquinoline because it is commercially available. The formula for 8-hydroxyquinoline is

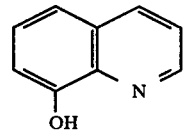

and it can be used in neutral or basic medium. However, it is preferable to use a basic solution, since it is more soluble in basic solution. It has lower solubility in neutral solution, and in acid solutions, the magnesium complex, if formed, is not fluorescent. Other members of the hydroxyquinoline family which are water-soluble can be applied in a similar manner. Members which are more soluble in organic solvents can be applied as a solution in such a solvent.

The hydroxyquinoline family is exemplified by the following list (which is not exclusive):

8-Hydroxyquinaldine (2-methyl-8-quinolinol)
4-Hydroxyquinoline trihydrate (4-quinolinol)
5-hydroxyquinoline (5-quinolinol)
8-Hydroxyquinoline (8-quinolinol)
4-Hydroxyquinoline-2-carboxylic acid (kynurenic acid)
8-Hydroxyquinoline-N-oxide (8-quinoline N-oxide)
2-Quinolinol
7-Quinolinol
8-Quinolinol To condition the ore, the coupling agent in solution is mixed with the ore. Many methods can be employed to contact the coupling agent solution with the ore. Such methods include, but are not limited to, spraying the solution onto the particles, passing the particles through a solution bath, and the like (e.g., see Ser. No. 897,946, now abandoned and, preferably Ser. No. 45,186, now U.S. Pat. No. 4,241,102). It is preferred to spray the preferred to spray the solution on the ore particles. Such a spraying operation can consist of spraying the ore particles as they pass on a belt on shaker bed (e.g., Ser. No. 45,186, now U.S. Pat. No. 4,241,102). Due to the surface properties of the magnesium compound in the magnesian mineral, the coupling agent selectively adheres to the surface of the magnesian mineral, and said mineral will have a coating capable of fluorescing, which allows the magnesian mineral to be separated from the lesser coated or substantially non-coated refuse present in the ore.

Following the conditioning of the ore, the ore is exposed to electromagnetic radiation to cause the coating on the magnesian mineral particles to fluoresce. The coated fluorescing particles can be separated from the lesser fluorescing or substantially non-fluorescing particles by many different means, such as by hand or by an optical sorting device, such as the apparatus taught by Matthews in U.S. Pat. No. 3,472,375 or that by Buchot et al. in U.S. Pat. No. 3,795,310.

In the Matthews apparatus, a free-falling mixture of potentially fluorescent ore particles passes in front of a row of detectors, while being illuminated with electromagnetic radiation. Each detector, by proper attenuation, is capable of distinguishing between fluorescence or non-fluorescence or between degrees of fluorescence. Each detector, in turn, controls one flowing fluid stream selectively directed transverse to the path of the falling particle, the fluid stream being permitted to impinge only on the properly emitting ore particles. The directed fluid stream deflects the ore particles into a divergent path by which they are separted from the undesired ore particles. Such an apparatus is capable of detecting and separating the coupling agent coated particles from the non-coated particles. As an alternative to free-fall, the ore particles can be separated while being transported on a moving conveyor, such as a belt or screen.

The invention is further illustrated by the following examples, which are not intended to be limiting.

EXAMPLE 1

A synthetic sample of magnesite, calcite and siliceous rock was formulated containing 26.8% magnesite, 30.4% calcite and 42.8% siliceous rock in particles of about 1 inch to 3 inch screen size. After washing, the material was conditioned with a 0.1% solution of 8-hydroxyquinoline in water, as the sodium salt. After conditioning, the material was rinsed and passed through an irradiation device to induce fluorescence. A visible difference between magnesium rich ore particles and magnesium lean ore particles was detected during irradiation which permitted hand sorting of the particles.

Hand sorting of the conditioned, fluorescing particles produced the fractions shown below in weight %:

| FRACTION | % Separation | % Magnesite | % Distribution* |
|---|---|---|---|
| Eject | 25.1 | 88.0 | 82.3 |
| Reject | 74.9 | 6.3 | 17.7 |
| Head (Feed) | 100.0 | 26.8 | 100.0 |

*"Distribution" is weight % of total magnesite in original sample.

By "eject" is meant that in a Mathews-type separator, the particle would be deflected (or ejected) from its free-fall path.

EXAMPLE 2

A similar synthetic sample of particles comprising 38.8% magnesite, 41.8% limestone, and 19.4% siliceous rock was treated as in Example 1.

Hand sorting the conditioned, fluorescing particles gave the following result:

| FRACTION | % Separation | % Magnesite | % Dist. |
|---|---|---|---|
| Eject | 41.8 | 79.0 | 85 |
| Reject | 58.2 | 10.0 | 15 |
| Head | 100.0 | 38.8 | 100.0 |

EXAMPLE 3

A batch of particulate rock containing 59.3% talc was conditioned with 0.1% 8-hydroxyquinoline solution, rinsed and induced to fluoresce, as in Example 1. Hand sorting the conditioned, fluorescing products gave the following result:

| FRACTION | % Separation | % Talc | % Dist. |
|---|---|---|---|
| Eject | 62.0 | 85.7 | 89.7 |
| Reject | 38.0 | 17.6 | 11.3 |
| Head | 100.0 | 59.3 | 100.0 |

EXAMPLE 4

A talc ore from Montana was crushed to 1" to 4", treated with 8-hydroxyquinoline (0.1%) and processed in a pilot plant fluorescent separator (as in the patents to Mathews). Five runs were made with the following results in weight %:

| | % FRACTION | | % TALC | | % DOLOMITE | |
|---|---|---|---|---|---|---|
| RUN # | Eject | Reject | Eject | Reject | Eject | Reject |
| 1 | 42.5 | 57.5 | 63 | 25 | 37 | 75 |
| 2 | 17.3 | 82.7 | 86 | 25 | 39 | 61 |
| 3 | 62.9 | 37.1 | 61 | 13 | 39 | 87 |
| 4 | 26.1 | 73.9 | 89 | 37 | 11 | 63 |
| 5 | 69.2 | 30.8 | 54 | 19 | 46 | 81 |

What is claimed is:

1. A process for separation of magnesium-rich first ore particles containing an exposed magnesian mineral on the surface of said magnesium-rich ore particles from magnesium lean second ore particles containing a lesser surface area of said exposed magnesian mineral on its surface than the first ore particles, said process comprising the steps of:

a. conditioning particulate ore comprising said magnesium-rich ore particles and said magnesium lean ore particles with a conditioning agent comprising at least one hydroxyquinoline which by irradiation with electromagnetic radiation can be induced to fluoresce at at least one particular wavelength when combined with said magnesian mineral on the surface of said ore particles and which causes said magnesium lean ore particles after said conditioning and upon said irradiation to fluoresce at a substantially lower intensity or not at all at said particular wavelength than the intensity of said fluorescence of said irradiated, conditioned, magnesium-rich ore particles;

b. after said conditioning, irradiating said magnesium-rich and said lean ore particles with electromagnetic radiation to produce sufficient fluorescence of said conditioned and irradiated magnesium-rich ore particles to enable the difference in fluorescent intensity between said irradiated, conditioned magnesium rich ore particles and the irradiated, conditioned magnesium lean ore particles to be detected;

c. detecting the fluorescent intensity of said irradiated, conditioned ore particles; and, d. separating said magnesium-rich ore particles from said lean ore particles based on the detected differences in fluorescent intensity of said conditioned, irradiated ore particles.

2. The process of claim 1 wherein said hydroxyquinoline comprises 8-hydroxyquinoline.

3. A process as in claim 2, in which the ore particles are coated in a degree dependent upon the grade of the ore and in which coated gangue particles and lesser coated lower grade ore particles are distinguished and separated from substantially uncoated higher grade ore particles.

4. The process of claim 1 wherein said conditioning agent comprises an aqueous solution of an ammonium or alkali metal salt of 8-hydroxyquinoline.

5. The process of claim 4 wherein said salt comprises the sodium salt of 8-hydroxyquinoline.

6. A process for separating magnesium-rich ore particles having a surface containing an exposed magnesian mineral from a particulate ore containing said magnesium-rich ore particles and lean ore particles having substantially less surface containing said exposed magnesian mineral, said process comprising:

(a) conditioning said particulate ore with an aqueous solution of a detectable marking agent comprising 8-hydroxyquinoline or an alkali metal salt thereof, to produce a conditioned particulate ore;

(b) passing said conditioned, particulate ore in free-fall through a detector zone wherein the detectable making agent is induced to fluoresce by irradiation with electromagnetic radiation;

(c) detecting the intensity of fluorescence of each free-falling particle; and, (d) deflecting, from its free-fall path, a free-falling, magnesium-rich ore particle exhibiting a fluorescence of an intensity higher than a chosen intensity with a directed fluid stream that impinges on said free-falling magnesium-rich ore particle which is detected as exhibiting said fluorescence of an intensity higher than said chosen intensity.

7. The process of claim 6 wherein said conditioning includes contacting the particulate ore with said aqueous solution and then rinsing the contacted particles to remove excess marking agent.

* * * * *